US007637982B2

(12) United States Patent
Hou et al.

(10) Patent No.: US 7,637,982 B2
(45) Date of Patent: Dec. 29, 2009

(54) METHOD FOR MAKING WICK STRUCTURE OF HEAT PIPE AND POWDERS FOR MAKING THE SAME

(75) Inventors: Chuen-Shu Hou, Tu-Cheng (TW); Tay-Jian Liu, Tu-Cheng (TW); Chao-Nien Tung, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 400 days.

(21) Appl. No.: 11/309,072

(22) Filed: Jun. 15, 2006

(65) Prior Publication Data

US 2007/0077165 A1 Apr. 5, 2007

(30) Foreign Application Priority Data

Sep. 16, 2005 (CN) ..... 2005 1 0037370

(51) Int. Cl.
*B22F 1/00* (2006.01)
*B22F 3/10* (2006.01)
*B22F 5/00* (2006.01)

(52) U.S. Cl. ..... 75/255; 419/9; 419/23

(58) Field of Classification Search ..... 75/255; 419/8, 9, 232, 23; 252/514
See application file for complete search history.

(56) References Cited

U.S. PATENT DOCUMENTS

| | | | | |
|---|---|---|---|---|
| 4,196,504 | A * | 4/1980 | Eastman | 29/890.032 |
| 6,994,152 | B2 * | 2/2006 | Rosenfeld et al. | 165/104.21 |
| 2006/0180296 | A1 * | 8/2006 | Liu | 165/104.26 |
| 2006/0198753 | A1 * | 9/2006 | Hong et al. | 419/23 |

FOREIGN PATENT DOCUMENTS

| | | | |
|---|---|---|---|
| CN | 1435669 | A | 8/2003 |

* cited by examiner

*Primary Examiner*—Roy King
*Assistant Examiner*—Ngoclan T Mai
(74) *Attorney, Agent, or Firm*—Frank R. Niranjan

(57) ABSTRACT

A group of powders (40) for making a wick structure of a heat pipe includes main powders (50) and supplemental powders (60). The melting point of the supplemental powder is lower than that of the main powder. During a sintering process, the powders are filled in a casing of the heat pipe and have a eutectic reaction between the main powders and the supplemental powders to form the wick structure. The temperature for the eutectic reaction is lower than the melting temperature of the supplemental powders.

8 Claims, 3 Drawing Sheets

METHOD FOR MAKING WICK STRUCTURE OF HEAT PIPE AND POWDERS FOR MAKING THE SAME

FIELD OF THE INVENTION

The present invention relates generally to a heat pipe for transfer or dissipation of heat from heat-generating components such as electronic components, and more particularly to a method and powders for manufacturing a wick structure for the heat pipe.

DESCRIPTION OF RELATED ART

Heat pipes have excellent heat transfer performance due to their low thermal resistance, and therefore are an effective means for transfer or dissipation of heat from heat-generating components such as central processing units (CPUs) of computers. A heat pipe is usually a vacuum casing containing therein a working fluid, which is employed to carry, under phase transition between liquid state and vapor state, thermal energy from one section of the heat pipe (typically referred to as the "evaporating section") to another section thereof (typically referred to as the "condensing section"). The casing is made of copper which has high thermally conductive. Preferably, a wick structure is provided inside the heat pipe, lining an inner wall of the casing, for drawing the working fluid back to the evaporating section after it is condensed at the condensing section. Specifically, as the evaporating section of the heat pipe is maintained in thermal contact with the heat-generating component, the working fluid contained at the evaporating section absorbs heat generated by the heat-generating component and then turns into vapor. Due to the difference of vapor pressure between the two sections of the heat pipe, the generated vapor moves towards and carries the heat simultaneously to the condensing section where the vapor is condensed into liquid after releasing the heat into ambient environment by, for example, fins thermally contacting the condensing section. Due to the difference of capillary pressure developed by the wick structure between the two sections, the condensed liquid is then drawn back by the wick structure to the evaporating section where it is again available for evaporation.

The wick structure currently available for heat pipes includes fine grooves integrally formed at the inner wall of the casing, screen mesh or bundles of fiber inserted into the casing and held against the inner wall thereof, or sintered powders combined to the inner wall by sintering process. Among these wicks, the sintered powder wick is preferred to the other wicks with respect to heat transfer ability and ability against gravity.

Currently, a conventional method for making a sintered powder wick includes filling copper powder necessary to construct the wick into a hollow casing which has a closed end and an open end. A mandrel has been inserted into the casing through the open end of the casing; the mandrel functions to hold the filled powders against an inner wall of the casing. Then, the casing with the powder is sintered at high temperature for a specified time period to cause the powder to diffusion bond together to form the wick. As the melting point of copper is about 1080° C., the sintering temperature range is about 850~980° C. However, the volume of the copper powder at the temperature range of 600~800° C. expands to 1.02~1.03 times of that of the copper powder at room temperature. After the sintering process, the wick structure and the mandrel may join together by the diffusion bonding. The wick structure contacts an outer surface of the mandrel intimately. Thus, a relatively large force is needed to draw the mandrel out of the wick structure and the hollow casing. The wick structure is possibly to be destroyed by the large drawing force acting on the mandrel. On the other hand, the casing of the heat pipe is possible to deform under the high sintering temperature, which adversely affects the heat transfer performance of the heat pipe.

Therefore, it is desirable to provide a method of manufacturing a sintered powder wick by a sintering process. In the method, the required sintering temperature for the sintering process can be lowered to a suitable range to avoid an undue expansion of the powders for constructing the wick.

SUMMARY OF THE INVENTION

According to a preferred embodiment of the present invention, powders for making a wick structure of a heat pipe include a main type of powders and a supplemental type of powders. The melting point of the supplemental powder type of powders is lower than that of the main type of powders. The powders are filled into a casing which has been inserted with a mandrel therein. Then, the powders are subjected to a sintering process with a temperature range causing the supplemental type of powders and the main type of powders to have a eutectic reaction and bond diffusion. Such a temperature range is lower than melting temperatures for the main type of powders and the supplemental type of powders and the temperature range for the main type of powders to have an undue expansion. Thus, the powders used to form the wick structure are bonded together by the bond diffusion of the supplemental type of powders and the main type of powders at the eutectic temperature. Accordingly, the possibility and strength of the joint between the sintered powders and the mandrel is lowered. The possibility of the deformation of the casing due to the high temperature range of the sintering process is avoided.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present powders and method for manufacturing wick structure of heat pipe can be better understood with reference to the following drawings. The components in the drawings are not necessarily drawn to scale, the emphasis instead being placed upon clearly illustrating the principles of the present powders and method for manufacturing wick structure of heat pipe. Moreover, in the drawings, like reference numerals designate corresponding parts throughout the several views.

DETAILED DESCRIPTION OF THE INVENTION

Figure 1:
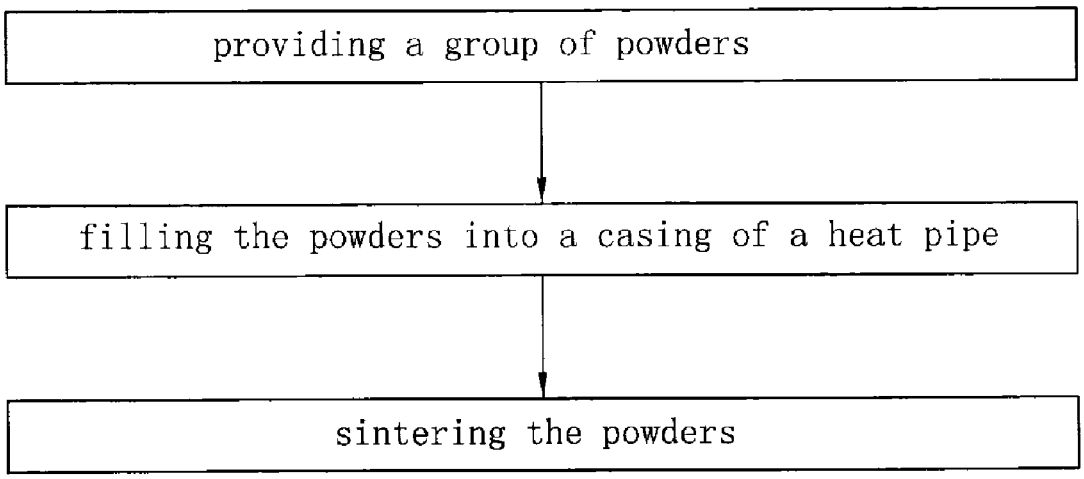
FIG. 1 is a flow chart of a preferred method in accordance with the present invention, for manufacturing a wick structure applicable in a heat pipe.

FIG. 1 shows a preferred method in accordance with the present invention for producing a porous wick structure that can be suitably applied to heat pipes or other heat transfer devices such as vapor chamber-based heat spreaders. The wick structure is constructed from powders and a sintering process is required to form the wick structure.

Figure 2:
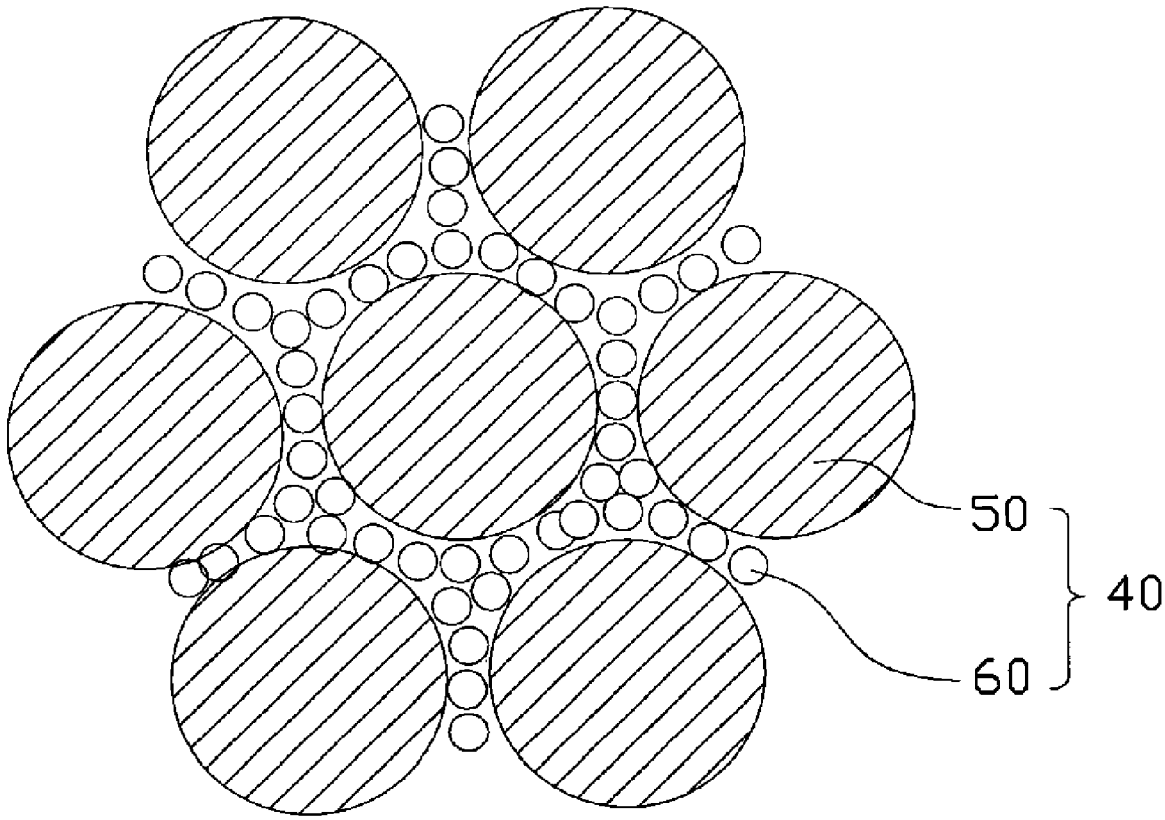
FIGS. 2-3 are schematic diagrams of powders in forming the wick structure by using the method of FIG. 1.
Figure 3:
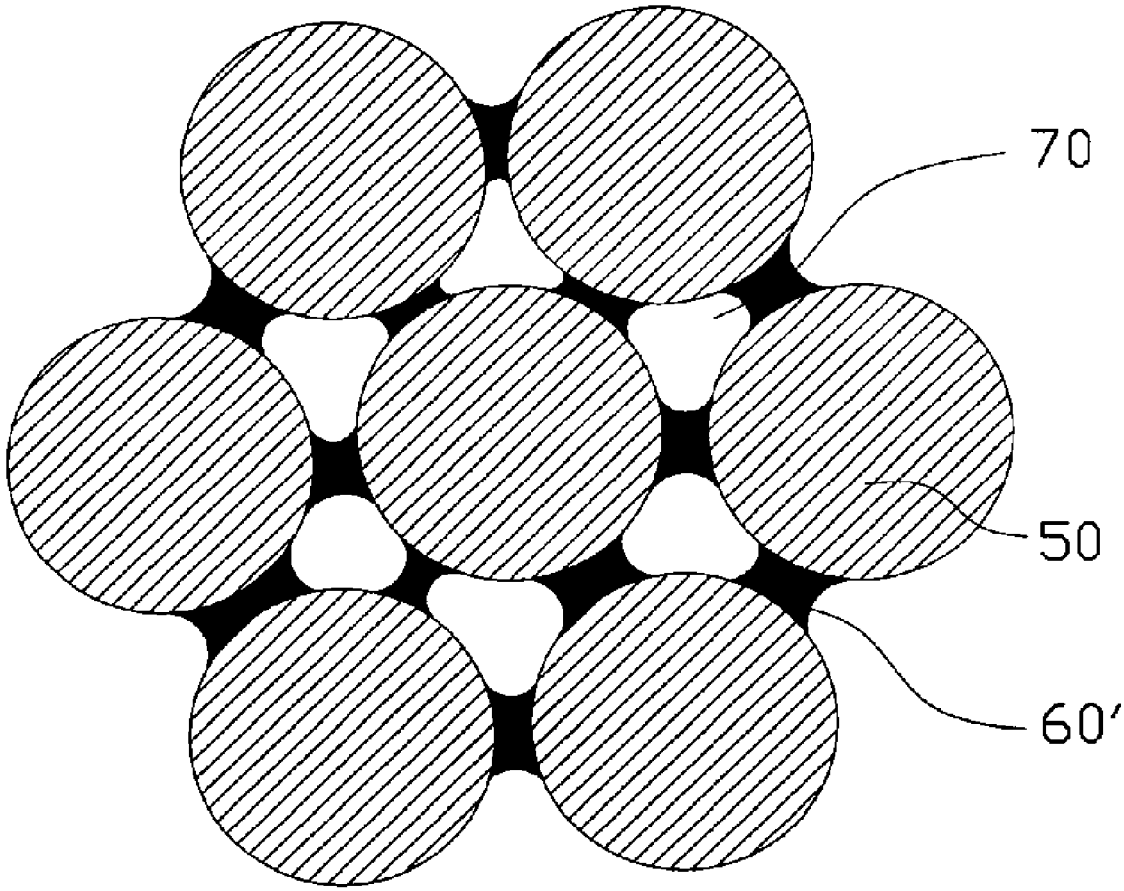

As shown in FIGS. 2-3, firstly, a group of powders 40 is provided; the powders 40 include a main type of powders 50 and a supplemental type of powders 60. The melting point of the main type of powders 50 is higher than that of the supplemental type of powders 60. In this embodiment, the main type of powders 50 is made of Cu (copper) which has a melting point about 1080° C., whilst the supplemental type of powders 60 is made of Al (aluminum) which has a melting point about 660° C. The Cu powders 50 each have a powder size ranging from 50 to 200 mesh. The "mesh" used herein represents the number of openings defined in per unit area, i.e., square inch, of a standard screen. A standard screen is a well known apparatus widely used to classify objects (such as the powders 40 or the like) based on their sizes. If a standard screen is used to classify powders, the number of openings in per unit area of the standard screen is usually used to indicate the powder size of the powders that pass through the standard screen. The diameter of the Cu powders 50 is ranging from 90~300 μm. The Al powders 60 have an average diameter about 20 μm which is smaller than that of the Cu powders 50. The volume of the Al powders 60 is about 4% of that of the total powders 40. The Cu and Al powders 50, 60 are mixed together. Each Cu powder 50 has at least an Al powder 60 adhered to an outer surface thereof, as shown in FIG. 2.

The Cu and Al powders 50, 60 after mixed are then filled into a casing of the heat pipe. Although it is not shown in the drawings, it is well known by those skilled in the art that a mandrel is typically used to hold the powders 40 against an inner wall of the casing. The casing is then placed into an oven and the powders 40 are subsequently sintered. The powders 40 used to construct the wick structure are consisted of Cu powders 50 and Al powders 60 having a melting point about 660° C. The temperature of eutectic reaction of the Cu and Al powders 50, 60 is about 548° C. Before the temperature of the oven reaches 540° C., the Cu powders 50 do not have a eutectic reaction with the Al powders 60 since an oxide-layer formed on the outer surface of each Cu powder 50 has not been reduced. When the sintering temperature increases to 540~580° C., the eutectic reaction takes place between the Cu and Al powders 50, 60. The temperature for the eutectic reaction is lower than the melting points of the Al powders 60 and the Cu powders 50. By the eutectic reaction, the Al powders 60 and the Cu powders 50 have diffusion bond to join together. At this temperature range, however, the size of the Cu powders 50 which have a relatively high melting point is almost unchanged. Only the outer surfaces of oxide-layers of the Cu powders 50 are melted to bind with the molten Al powders 60. As illustrated in FIG. 3, in this case, the molten Al powders 60 flow to and interconnect the Cu powders 50 together. A plurality of necks 60' is formed between the Cu powders 50 by the molten Al powders 60. Meanwhile, a plurality of voids 70 is formed between the Cu powders 50. These voids 70 are communicated with each other so as to form a continuous, liquid passageway. Then after the powders 40 sintered under 560~580° C. for a predetermined period of time, the wick structure is formed. In this example, the Al powders 60 have a relatively low melting point. On this basis, the sintering temperature range of the powders 40 is less than 600° C. The expansion ratio of 2%~3% of the Cu powders 50 is avoided. The mandrel is easily to draw out after the sintering process. The sintering temperature range of 560~580° C. does cause the casing for forming the heat pipe to deform.

Following the above-mentioned example, a wick structure may also be constructed by powders 40 having a supplemental type of powders 60 made of other materials other than Al, only if the supplemental type of powders 60 has a melting point lower than that of Cu. For example, Zn (zinc), Ag (silver), Pb (lead), Sn (tin), Bi (bismuth) and the like. Generally the volume of the supplemental type of powders 60 is lower than 30% of that of the powders 40 to obtain excellent heat transfer performance of the heat pipe. The supplemental type of powders 60 of the previous embodiments is selected from a metal having a melting point lower than that of Cu to decrease the sintering temperature of the powders 40.

Also the supplemental type of powders 60 can be selected from nano-particles having a diameter ranging from 1~100 nm. The nano-particles have very higher surface energy and thus the melting point of the nano-particles is much lower than that of the particles which are made of the same material but have a size larger than that of the nano-particles. For example, the melting point of nano-particles of copper is about 257~372° C. The melting point of Au (gold) is about 1064° C. However, when the nano-particles of gold has a diameter about 10 nm, the melting point thereof decreases about 27° C. Furthermore, when the diameter is 2 nm, the melting point of the nano-particles of gold decreases to only 327° C. Also the nano-particles can be made from other metal, such as Al, Zn, Sn, Ni (nickel), Ag, etc. During the sintering process, the sintering temperature of the powders 40 can be decreased to the lower melting point of the nano-particles. In this embodiment, the main type of powders 50 is Cu powders with a diameter of 90~300 μm. The supplemental type of powders 60 is Cu powders with a diameter of 1~100 nm. Thus, the undue and undesired expansion of the Cu powders 50 during the sintering process of the heat pipe can be avoided since the sintering temperature is lowered to 257~372° C. It is can be understood that main type of powders 50 is not limited to Cu, it also can be made of other metals having high heat conductivity coefficient. Under this situation, the supplemental type of powders 60 is made of the other metals correspondingly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of manufacturing a wick structure for a heat pipe comprising steps of:

providing a group of powders comprising a kind of main powders and a kind of supplemental powders having a melting point lower than that of the main powders, the main powders and the supplemental powders being thoroughly mixed;

filling the group of powders into a casing of the heat pipe; and sintering the powders at a temperature no higher than the melting temperature of the supplemental powders;

wherein the supplemental powders are nano-particles; and wherein the nano-particles are made of one of the following materials: copper, gold, aluminum, zinc, tin, nickel, and silver and the main powders are made of a material the same as that for making the supplemental powders.

2. The method of claim 1, wherein a volume of the supplemental powders is not larger than 30% than a volume of the group of powders.

3. The method of claim 1, wherein a powder size of the main powders is larger than that of the supplemental powders.

4. The method of claim 1, wherein the main powders are made of copper, an expansion ratio of the copper powders during the sintering process is not larger than 2%.

5. The method of claim 1, wherein the sintering temperature is the melting temperature of the supplemental powders.

6. A group of powders for making a wick structure of a heat pipe comprising:

a kind of main powders; and a kind of supplemental powders thoroughly mixed with the main powders, the supplemental powders having a melting point lower than that of the main powders, the group of powders being sintered at a temperature no higher than the melting temperature of the supplemental powders to make the wick structure;

wherein the main powders and the supplemental powders are made of same metal, and the supplemental powders are nano-particles having a powder size of 1~100 nm.

7. The powders of claim 6, wherein the supplemental powders are made of one of following metals: aluminum, zinc, silver, tin, copper, gold, nickel, and the main powders have a powder size larger than that of the supplemental powders.

8. The powders of claim 6, wherein the sintering temperature is the melting temperature of the supplemental powders.

* * * * *

UNITED STATES PATENT AND TRADEMARK OFFICE

CERTIFICATE OF CORRECTION

PATENT NO. : 7,637,982 B2
APPLICATION NO. : 11/309072
DATED : December 29, 2009
INVENTOR(S) : Hou et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 597 days.

Signed and Sealed this

Ninth Day of November, 2010

David J. Kappos

David J. Kappos
*Director of the United States Patent and Trademark Office*